US005706853A

United States Patent [19]

Rønnow et al.

[11] Patent Number: 5,706,853

[45] Date of Patent: Jan. 13, 1998

[54] VALVE, ESPECIALLY A THERMOSTATIC EXPANSION VALVE

[75] Inventors: Allan Rønnow, Sønderborg; Anders Vestergaard, Sydals; Jens Erik Rasmussen, Gråsten, all of Denmark

[73] Assignee: Danfoss A/S, Nordborg, Denmark

[21] Appl. No.: 704,562

[22] PCT Filed: Mar. 21, 1995

[86] PCT No.: PCT/DK95/00125

§ 371 Date: Sep. 10, 1996

§ 102(e) Date: Sep. 10, 1996

[87] PCT Pub. No.: WO95/26477

PCT Pub. Date: Oct. 5, 1995

[30] Foreign Application Priority Data

Mar. 25, 1994 [DE] Germany ..... 44 10 346.8

[51] Int. Cl.[6] ..... F16K 31/12

[52] U.S. Cl. ..... 137/505.14; 62/225; 236/92 B; 137/495

[58] Field of Search ..... 137/505.14, 495; 62/225; 236/92 B

[56] References Cited

U.S. PATENT DOCUMENTS

| | | | |
|---|---|---|---|
| 2,182,718 | 12/1939 | Anderson et al. | 236/92 B |
| 2,258,295 | 10/1941 | Merz | 236/92 B |
| 5,148,978 | 9/1992 | Stapelbroek | 236/92 B |
| 5,186,207 | 2/1993 | Kaneko | 137/495 |

FOREIGN PATENT DOCUMENTS

| | | | |
|---|---|---|---|
| 946142 | 3/1962 | United Kingdom | 62/225 |

*Primary Examiner*—Denise L. Ferensic
*Assistant Examiner*—Ramyar M. Farid
*Attorney, Agent, or Firm*—Lee, Mann, Smith, McWilliams, Sweeney & Ohlson

[57] ABSTRACT

A valve, especially a thermostatic expansion valve, has a setpoint spring which bears on a plate having a sloping face. A setpoint adjusting device is provided in a housing connecting tube. The adjusting device has a pressure-applying piece having a contact face engaging the sloping face, is secured against rotation and has a threaded bore. An adjusting screw which is supported on the connecting tube against axial displacement engages in this threaded bore. In this construction, the connecting tube requires no machining.

16 Claims, 3 Drawing Sheets

VALVE, ESPECIALLY A THERMOSTATIC EXPANSION VALVE

The invention relates to a valve, especially a thermostatic expansion valve, having a housing carrying a valve seat, having a closure member which is movable by the force of a working element against the force of a setpoint spring, and having a setpoint adjusting device housed in a lateral connecting tube, which adjusting device engages by means of a contact face with a sloping face of an axially guided plate supporting the setpoint spring and has an adjusting screw for displacing the contact face with a component acting radially with respect to the plate axis.

Such valves are known, for example, from DE-PS 964 241 or FIG. 7 of U.S. Pat. No. 5,186,207. The control by means of a sloping face of the plate supporting the setpoint spring has the advantage that a compact type of construction is produced. Manufacture requires a considerable degree of machining, however, for example, in the cutting of a thread in the connecting tube receiving the setpoint adjusting device.

Figure 1:
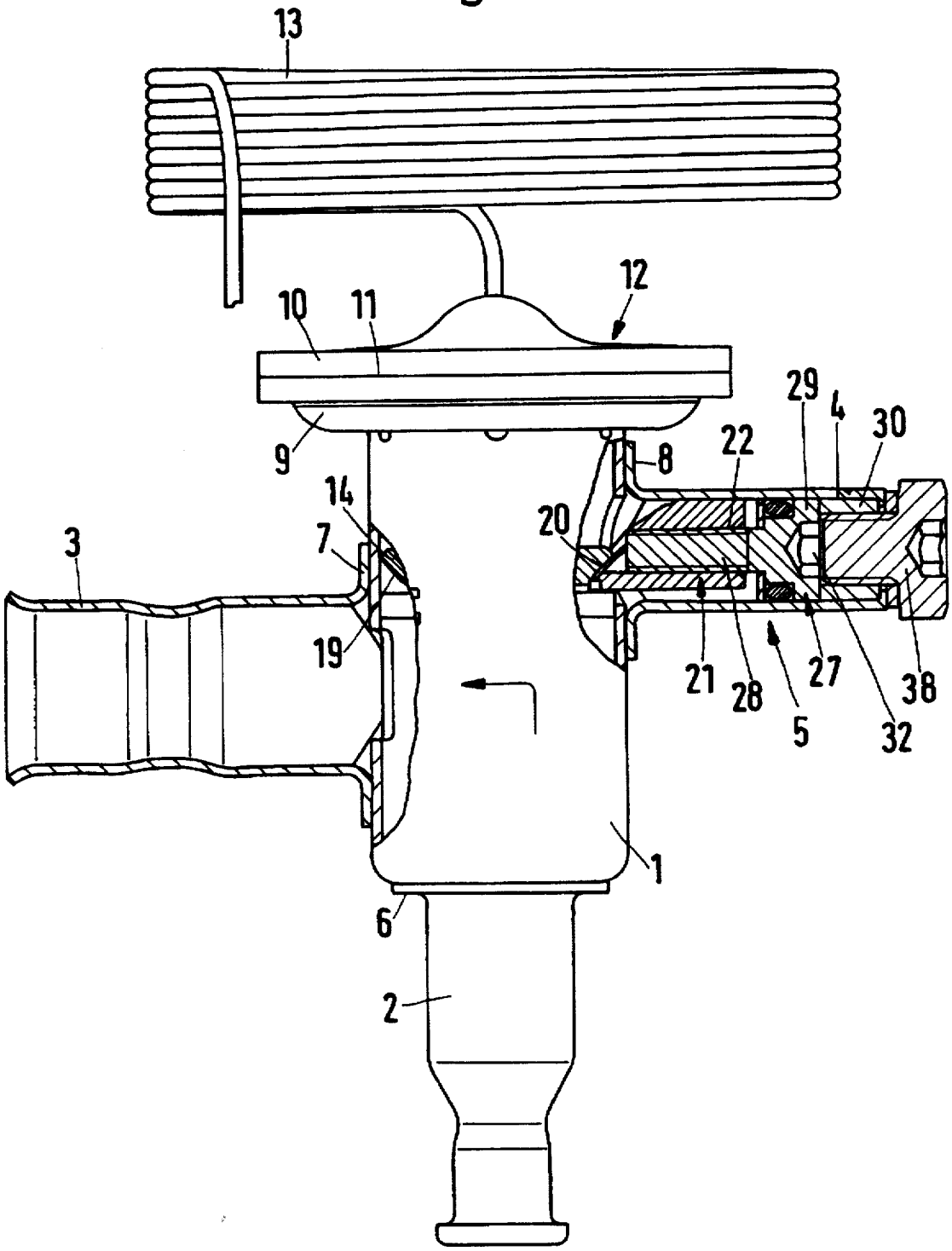
Figure 4:
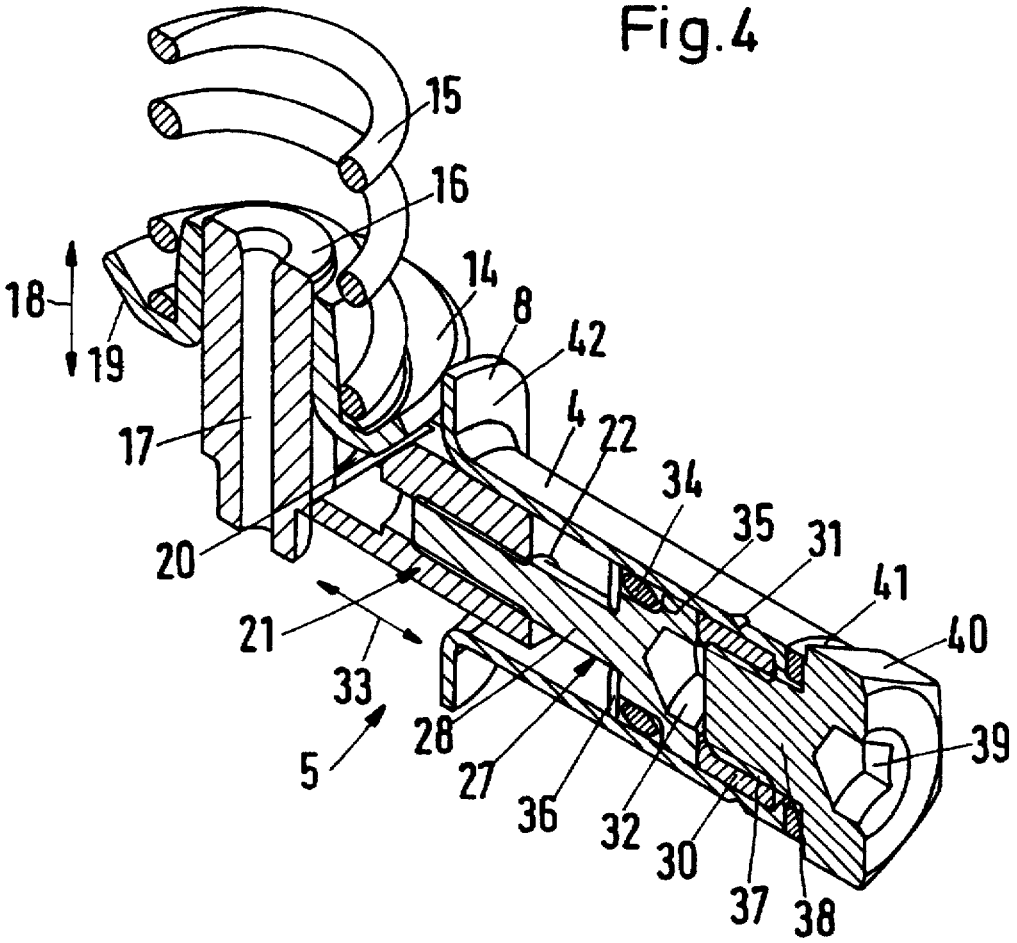

In FIGS. 1 and 4 of U.S. Pat. No. 5,186,207, inlet and outlet connecting tubes are formed by portions of tube inserted in the remainder of the housing. For the purpose of adjustment, a pressure-applying piece bears by means of a sloping contact face on the sloping face of the plate supporting the setpoint spring, and is secured in its position by indentations in the tube wall of the outlet connecting tube. Subsequent adjustment of the set point is not possible in this case, however.

The invention is based on the problem of providing a valve of the kind mentioned at the outset, in which machining in the area of the setpoint adjusting device is reduced or completely avoided.

This problem is solved according to the invention in that the adjustment device comprises a pressure-applying piece which carries the contact face, is secured against rotation and has a threaded bore, and the adjusting screw engages with its shank in the threaded bore and is secured against displacement by bearing against the connecting tube.

By separating the contact face and the adjusting screw the thread engagement can be moved from the housing to the pressure-applying piece. Means for preventing rotation of the pressure-applying piece and axial displacement of the adjusting screw are all that is required on the housing. This can be achieved without machining the housing. A further advantage consists in that the sloping contact face does not rotate with the adjusting screw. The contact face can therefore have a large area lying against the sloping face of the plate supporting the setpoint spring.

It is especially favourable for the connecting tube to be in the form of a shaped sheet metal part. The sheet metal can be easily shaped to fulfil the remaining functions (safeguarding against rotation, stop function).

It is also favourable for the connecting tube to be formed by a substantially cylindrical tube which is attached to a base housing. The tube can be pre-assembled together with the adjusting device, and subsequently joined to the base housing.

An especially simple means guarding against rotation is provided when the pressure-applying piece has on its circumference at least one longitudinal groove in which an indentation of the connecting tube wall engages.

In a further embodiment, a sealing ring surrounding the head of the adjusting screw is provided, the sealing ring being secured in position on one side by a flange on the head and on the other side by an annular limiting disc positioned against the head and held in place by an indentation in the connecting tube wall. The indentation can be identical to that for safeguarding against rotation. The sealing ring held fixedly in this manner between the flange and the annular disc effects a good seal with respect to the medium in the housing, especially a refrigerant.

Moreover, it is advisable for a bushing to be fitted at the outer end of the connecting tube, against which the head of the adjusting screw bears. This bushing therefore forms a stop member which secures the adjusting screw against axial displacement.

The bushing is preferably retained in position by indentations in the connecting tube wall. Normally, the indentations are sufficient to hold the bushing securely.

The head of the adjusting screw advantageously has a hexagon socket, the dimensions of which are smaller than the internal diameter of the bushing. The adjusting screw can therefore be easily adjusted despite the presence of the bushing.

In a preferred embodiment, provision is made for the bushing to have an internal thread in which the shank of a sealing screw engages, the head of which screw presses an annular sealing washer against the outer end face of the connecting tube. This sealing screw is an additional security measure which reliably prevents escape of the medium from the valve housing.

It is here advisable for the head of the sealing screw to have both a hexagon socket, which is the same as that of the adjusting screw, and an external hexagon head. If the hexagon socket of the sealing screw should ice up in an expansion valve of a refrigeration system, the screw can still be adjusted using the external hexagon head. There is no need to fear that the hexagon socket of the adjusting screw will ice up, because the refrigeration circuit contains no moisture.

It is also advantageous that the connecting tube has a flange with impressed weld buttons with which it is welded to the base housing, the space between the flange and the base housing being filled with solder. The connecting tube is therefore able to receive the adjusting device and then be attached to the base housing by welding, so that during the subsequent soldering process the force of the setpoint spring has no influence on the position of the connecting tube.

The connecting tube is advantageously a deep-drawn part. Such deep-drawn parts can be produced inexpensively, especially as such valves are manufactured in large piece numbers.

The pressure-applying piece should preferably be a sintered part. By sintering, one can produce the desired shape, including the threaded bore, without problems, especially as the pressure-applying piece is a comparatively small component.

The adjusting screw and the bushing can be parts manufactured in particular by cold flow methods. This also makes for an inexpensive construction.

Moreover, the annular limiting disc and the annular sealing washer can be stamped parts.

All the above-mentioned parts can therefore be manufactured without machining, so that the connecting tube and the entire adjusting device can be manufactured by processes conserving material.

Figure 2:
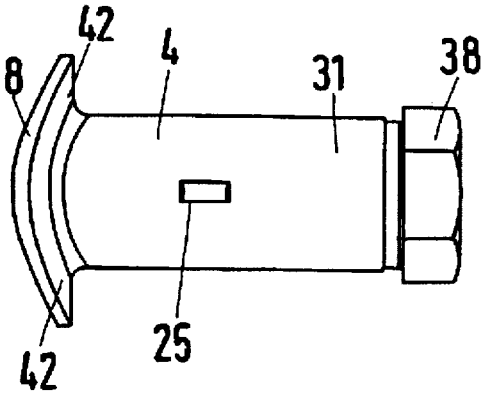
Figure 3:
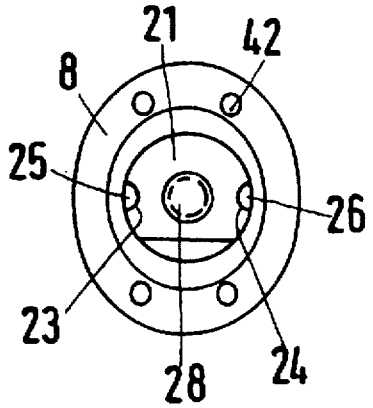
Figure 5:
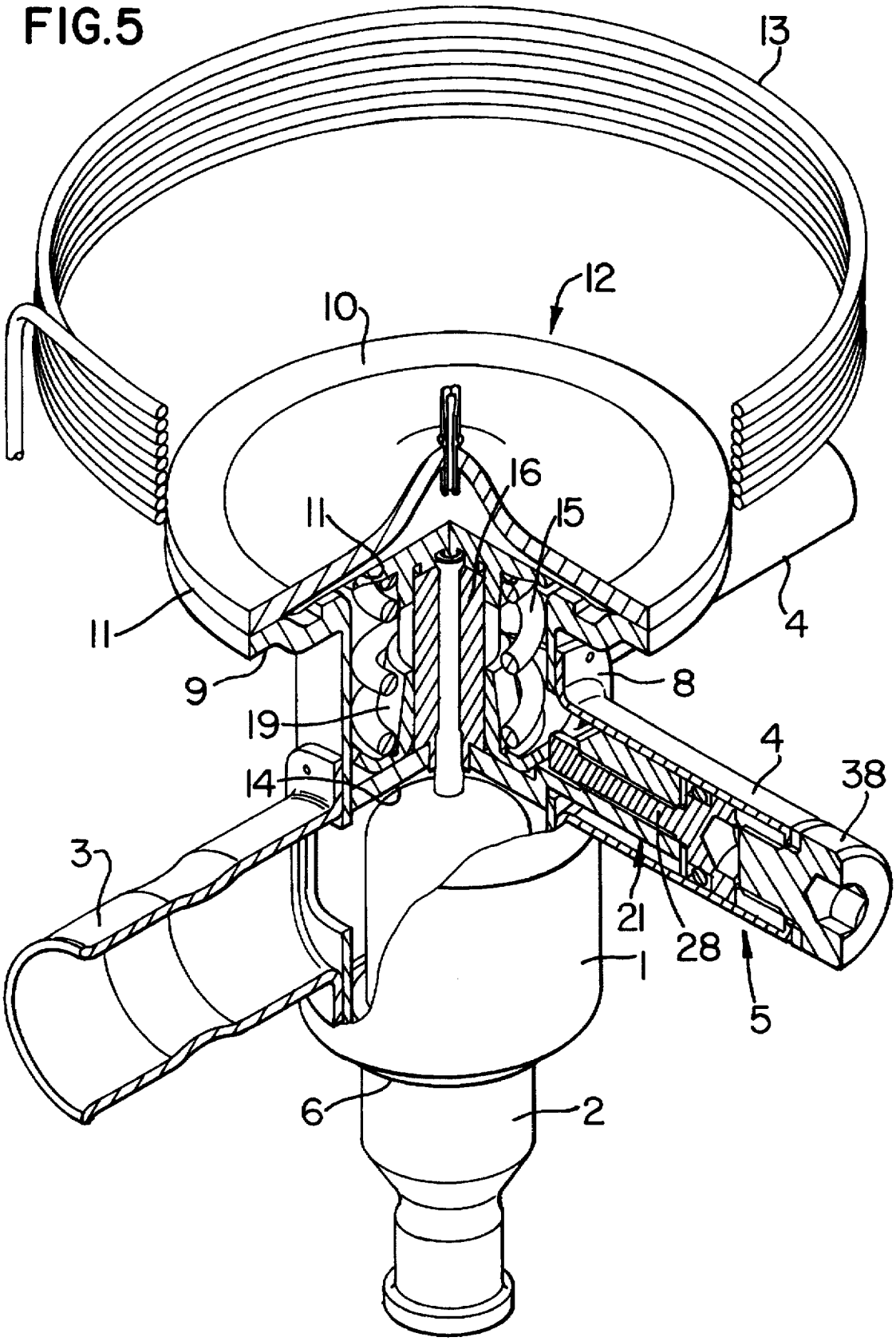

The invention is explained in further detail hereinafter with reference to a preferred embodiment illustrated in the drawings, in which FIG. 1 is a side view of a valve according to the invention, partly in section, FIG. 2 is a side view of a connecting tube for receiving the setpoint adjusting device, FIG. 3 is a view of the connecting tube of FIG. 2 from the left, FIG. 4 is a perspective sectional view of the connecting tube with the setpoint adjusting device inserted, and FIG. 5 is a perspective view of a valve according to the invention, more fully in section to show the internal detail.

The expansion valve illustrated in FIG. 2 comprises a base housing 1 to which an inlet connecting tube 2, an outlet connecting tube 3 and a connecting tube 4 for the setpoint adjusting device 5 are soldered by means of respective flanges 6, 7 and 8. The base housing and connecting tubes consist of shaped sheet metal parts which have been manufactured by deep drawing. The diaphragm 11 of a working element 12 is clamped between a cover ring 9 and a cover plate 10. The space above the diaphragm is connected by way of a capillary tube 13 to a pressure sensor or a pressure-generating temperature sensor, the pressure of which loads the diaphragm 11 from above. The refrigerant pressure prevailing in the valve and a setpoint spring 15 bearing against a plate 14 act on the diaphragm 11 in the opposite direction. The diaphragm moves the closure member, not shown, of the valve so that the output pressure of the valve is held at a predetermined value above the pressure supplied by way of the capillary tube 13, as is desirable, for example, to maintain a pre-determined degree of superheat at the end of an evaporator.

The plate 14 is axially guided on a bolt 16 built into the housing, and can be displaced in the direction of arrow 18; a connecting rod extends through the longitudinal bore 17 of the bolt in the customary manner between diaphragm 11 and closure member. The plate 14 furthermore has a sloping face 19 on which a sloping contact face 20 of the adjusting device 5 acts. The setpoint adjusting device 5 has a pressure-applying piece 21 which carries the sloping face 20, is secured against rotation and has a threaded bore 22. To secure it against rotation, the pressure-applying piece 21 has longitudinal grooves 23 and 24 lying opposite one another in which indentations 25 and 26 of the connecting tube wall on each side of the connecting tube engage. The setpoint adjusting device 5 furthermore has an adjusting screw 27, which engages by means of its threaded shank 28 in the threaded bore 22 and by means of its head 29 bears against the housing at a bushing 30 which is joined fixedly to the connecting tube 4 by means of indentations 31 in the connecting tube wall. The head 29 has a hexagon socket 32 having smaller dimensions than the inner diameter of the bushing 30. By screwing the adjusting screw 27 up or down, the pressure-applying piece 21 is displaced in the direction of the arrow 33. This movement is converted by the co-operation of the contact face 20 and sloping face 19 into the axial movement (arrow 18) of the plate 14, with the result that the bias of the setpoint spring 15 is altered.

A sealing ring 34 is located in a space which is defined in the radial direction by a cylindrical face of the screw head 29 and the connecting tube 4 and in the axial direction by a flange 35 of the screw head 29 and an annular limiting disc 36. The annular limiting disc is unable to yield because it is fixedly held in one direction by the screw head 29 and in the other direction by the indentations 25 and 26.

The bushing 30 has an internal thread 37 in which a sealing screw 38 engages, the head of which has a hexagon socket 39 and an external hexagon 40 for placement of a tool. As the sealing screw is tightened up, an annular sealing ring 41 is clamped between the end face of the connecting tube 4 and the underside of the head of the sealing screw 38. This seal is a standard part and can be provided with a friction-reducing nickel coating so that with little rotary torque a satisfactory sealing force is allowed. Such a seal can also be exchanged in a simple manner.

On the flange 8 there are provided four weld buttons 42, with which the connecting tube 4 can be temporarily attached to the base housing 1 by a welding process, before the space between the flange 8 and the base housing 1 is filled with solder. All parts of the setpoint adjusting device 5 can therefore be collected together in the connecting tube 4 and the connecting tube 4 can then be pressed with its flange 8 against the base housing 1 until the joining process is complete. In this manner, the parts of the set-point adjusting device are held captive in the valve housing.

We claim:

1. A thermostatic expansion valve having a housing with an inlet and an outlet, a valve seat interposed between the inlet and outlet, a closure member that is movable by a force of a working element against the combination of a force of a setpoint spring and fluid pressure in the housing, said setpoint spring being supported by an axially guided plate with a sloping face, and further having a setpoint spring adjusting device housed in a lateral connecting tube that is attached to said housing, said setpoint spring adjusting device comprising a pressure-applying piece with means to secure against rotation and having a contact face and an adjusting screw with means to secure against displacement, said contact face engaging said sloping face of said axially guided plate, said pressure applying piece having a threaded bore wherein a shank of the adjusting screw is engaged, the rotation of the adjusting screw causing the axial movement of the pressure-applying piece radially relative to a central axis of the guided plate and resulting in adjustment of the setpoint spring.

2. A valve according to claim 1, in which the connecting tube is in the form of a shaped sheet metal part.

3. A valve according to claim 1, in which the connecting tube comprises a substantially cylindrical tube.

4. A valve according to claim 1, in which the pressure-applying piece includes at least one longitudinal groove, the connecting tube having an indentation engaging the groove.

5. A valve according to claim 1, including a sealing washer surrounding a head of the adjusting screw, the sealing washer being maintained in place by a flange on the head and by an annular limiting disc positioned against the head and held in place by an indentation in the connecting tube.

6. A valve according to claim 1, in which the connecting tube has an outer end having a bushing against which a head of the adjusting screw bears.

7. A valve according to claim 6, in which the bushing is retained in position by indentations in the connecting tube wall.

8. A valve according to claim 6, in which the head of the adjusting screw has a hexagon socket which is smaller than the internal diameter of the bushing.

9. A valve according to claim 6, in which the bushing has an internal thread, and including a sealing screw having a shank engaging the internal thread, the sealing screw having a head pressing an annular sealing washer against an outer end face of the connecting tube.

10. A valve according to claim 9, in which the head of the sealing screw is hexagonal and has a hexagon socket.

11. A valve according to claim 1, in which the connecting tube has a flange with impressed weld buttons with which it is welded to the base housing, the buttons creating a space between the flange and the base housing, the space being filled with solder.

12. A valve according to claim 1, in which the connecting tube is deep-drawn.

13. A valve according to claim 1, in which the pressure-applying piece is sintered.

14. A valve according to claim 6, in which the adjusting screw and the bushing are manufactured by cold flow methods.

15. A valve according to claim 5, in which the annular limiting disc is a stamped part.

16. A valve according to claim 9, in which the sealing washer is a stamped part.

* * * * *